US010849203B2

(12) United States Patent
Satterfield et al.

(10) Patent No.: US 10,849,203 B2
(45) Date of Patent: Nov. 24, 2020

(54) MULTI-STRING LED CURRENT BALANCING CIRCUIT WITH FAULT DETECTION

(71) Applicant: TEXAS INSTRUMENTS INCORPORATED, Dallas, TX (US)

(72) Inventors: Garrett Warren Satterfield, Richardson, TX (US); Collin Philip Wells, Richardson, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/941,784

(22) Filed: Mar. 30, 2018

(65) Prior Publication Data

US 2019/0208589 A1 Jul. 4, 2019

Related U.S. Application Data

(60) Provisional application No. 62/612,734, filed on Jan. 2, 2018.

(51) Int. Cl.
*H05B 45/50* (2020.01)
*H05B 45/46* (2020.01)
*H05B 47/23* (2020.01)

(52) U.S. Cl.
CPC ..... *H05B 45/50* (2020.01); *H05B 45/46* (2020.01); *H05B 47/23* (2020.01)

(58) Field of Classification Search
None
See application file for complete search history.

(56) References Cited

U.S. PATENT DOCUMENTS

| | | | | |
|---|---|---|---|---|
| 6,847,169 | B2 * | 1/2005 | Ito | H05B 45/50 315/77 |
| 7,847,783 | B2 * | 12/2010 | Liu | H05B 45/46 345/102 |
| 8,810,153 | B2 * | 8/2014 | Yoshio | H05B 45/46 315/294 |
| 8,843,331 | B2 * | 9/2014 | Irissou | H05B 45/58 702/58 |
| 9,220,139 | B2 * | 12/2015 | Williams | H05B 45/48 |
| 9,232,587 | B2 * | 1/2016 | Williams | H05B 45/50 |
| 9,370,059 | B2 * | 6/2016 | Duan | H05B 45/10 |
| 9,451,664 | B2 * | 9/2016 | Jin | H01L 22/14 |
| 9,706,613 | B2 * | 7/2017 | Gibbs | H05B 45/37 |
| 9,736,898 | B2 * | 8/2017 | Doshi | H05B 45/37 |

(Continued)

FOREIGN PATENT DOCUMENTS

| | | |
|---|---|---|
| EP | 2487998 | 8/2012 |
| EP | 2487999 | 8/2012 |

*Primary Examiner* — Amy Cohen Johnson
*Assistant Examiner* — Srinivas Sathiraju
(74) *Attorney, Agent, or Firm* — Ray A. King; Charles A. Brill; Frank D. Cimino

(57) ABSTRACT

A lighting device circuit comprising: a reference LED string, a mirror LED string coupled in parallel to the reference LED string, an operational amplifier based current mirror circuit coupled to the reference LED string and to the mirror LED string, and a window comparator circuit that includes only a single input that is coupled to a fault sense node. The fault sense node directly connects to a drain node of a transistor within the operational amplifier based current mirror and a LED within the mirror LED string.

12 Claims, 7 Drawing Sheets

(56) References Cited

U.S. PATENT DOCUMENTS

| | | | | |
|---|---|---|---|---|
| 9,970,994 | B2 * | 5/2018 | Ikawa | H05B 45/46 |
| 2011/0221346 | A1 * | 9/2011 | Lee | H05B 45/395<br>315/122 |
| 2012/0013267 | A1 * | 1/2012 | Yoshio | H05B 45/46<br>315/297 |
| 2012/0200296 | A1 * | 8/2012 | Avenel | H05B 45/50<br>324/414 |
| 2012/0206146 | A1 * | 8/2012 | Avenel | H05B 45/50<br>324/414 |
| 2013/0249440 | A1 * | 9/2013 | Doshi | H05B 47/10<br>315/309 |

* cited by examiner

MULTI-STRING LED CURRENT BALANCING CIRCUIT WITH FAULT DETECTION

CROSS-REFERENCE TO RELATED APPLICATIONS

The present application claims priority to U.S. Provisional Patent Application No. 62/612,734, filed Jan. 2, 2018, titled "Dual String LED Current Balancing Circuit with Fault Detection," which is hereby incorporated herein by reference in its entirety.

BACKGROUND

Automotive lighting applications, such as Daytime Running Light (DRL), mount lighting devices at one or more locations of a motorized vehicle to emit light while the vehicle is in operation. In DRL applications, to enhance car safety, the lighting devices are automatically switched on when the vehicle is in drive mode. However, the constant emission of light generally increases fuel consumption since the power to run the lighting devices originates from the motor vehicle's engine system. To implement a low power solution for DRL applications, lighting devices may be built using two strings of light emitting diodes (LEDs). A two LED string topology can be chosen in order to diminish the need to generate a relatively high or boosted voltage to drive the LEDs. By utilizing relatively efficient LEDs along with a relatively lower voltage to drive the LEDs, a motor vehicle is able to consume less fuel to illuminate the lighting devices.

Unfortunately, a multi-string LED topology, such as the two LED string topology, could suffer from variety of drawbacks. One drawback is that the multi-string LED topology could have one LED string brighter than another string because of current variation. Also, if either of the LED strings suffer from an open or short failure, the voltage imbalance at the different LEDS strings could cause LED damage. For example, when one or more of the LEDs short within a lighting device, voltage variation across the LED could cause a relatively large amount of current to pass through one of the LED strings. In certain situations, the excessive amount of current passing through one of the LED strings could damage LEDs. The varying current at the different LED strings could also cause differences in light output amongst the different LED strings.

To account for the drawbacks associated with multi-string LED arrays, designers may include various circuits to balance the currents for the different LED strings. The circuits attempt to achieve the same amount of current to pass through each LED string even though the load and voltage across the LED string varies. Additionally, being able to accurately detect when failures occur within a LED string (e.g., open or short failures) allow users to determine when to replace and/or repair a lighting device. Hence, being able to accurately balance current amongst the LED strings and detect faults within the LED strings remains valuable in automotive and/or other lighting applications.

SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one implementation, a lighting device circuit comprising: a reference LED string, a mirror LED string coupled in parallel to the reference LED string, an operational amplifier based current mirror circuit coupled to the reference LED string and to the mirror LED string, and a window comparator circuit that includes only a single input that is coupled to a fault sense node. The fault sense node directly connects to a drain node of a transistor within the operational amplifier based current mirror and a LED within the mirror LED string.

In another implementation, a system comprising: a first string of light emitting components, a second string of light emitting components coupled in parallel to the first string of light emitting components, a current mirror circuit configured to match current flowing through the first of light emitting components with current flowing through the second string of light emitting components, and a window comparator circuit configured to compare a voltage at a single fault sense node to a reference high voltage and a reference low voltage. The single fault sense node directly connects to a light emitting component within the second string of light emitting components and a drain node of a transistor within the current mirror circuit.

In yet another implementation, an apparatus comprising: a light generation circuit comprising: a reference LED string, a mirror LED string coupled in parallel to the reference LED string, an operational amplifier based current mirror circuit that performs a current balance for the reference LED string and the mirror LED string, and a fault detection circuit that includes a comparator window circuit that has only a single input that receives voltage from a single fault sense node within the light generation circuit. The single fault sense node connects to a drain node of a transistor within the operational amplifier based current mirror circuit. The comparator window circuit does not receive voltages as input from other nodes within the light generation circuit.

BRIEF DESCRIPTION OF THE DRAWINGS

For a detailed description of various examples, reference will now be made to the accompanying drawings in which.

Figure 1:
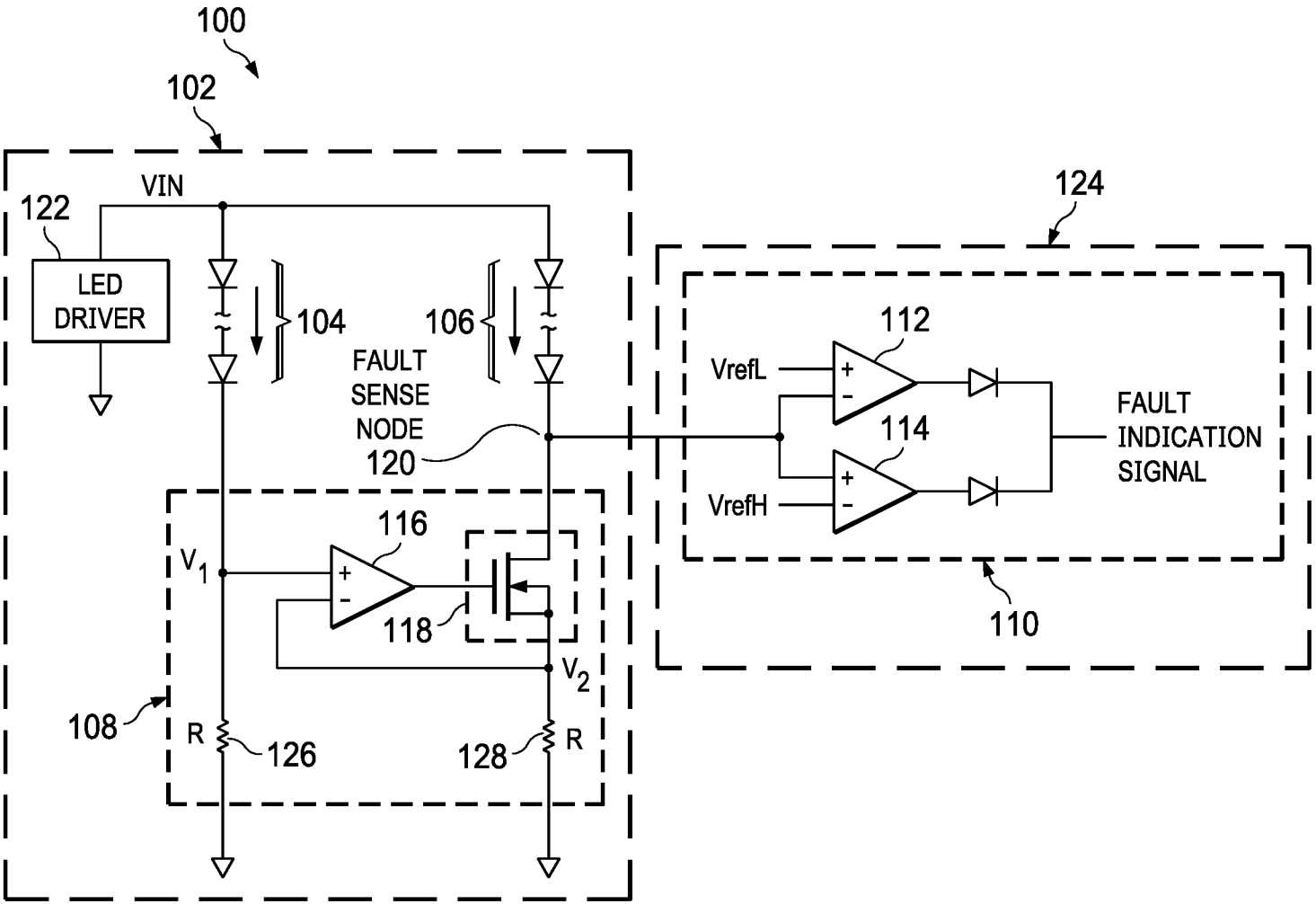
FIG. 1 is a block diagram of lighting device circuit in accordance with various implementations.

While certain implementations will be described in connection with the illustrative implementations shown herein, the invention is not limited to those implementations. On the contrary, all alternatives, modifications, and equivalents are included within the spirit and scope of the invention as defined by the claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct wired or wireless connection. Thus, if a first device couples to a second device, that connection may be through a direct connection or through an indirect connection via other devices and connections. The recitation "based on" is intended to mean "based at least in part on." Therefore, if X is based on Y, X may be a function of Y and any number of other factors.

The above discussion is meant to be illustrative of the principles and various implementations of the present invention. Numerous variations and modifications will become apparent to those skilled in the art once the above disclosure is fully appreciated. It is intended that the following claims be interpreted to embrace all such variations and modifications.

Various example implementations are disclosed herein to current balance parallel LED strings and detect LED faults within the LED stings. In one or more implementations, the lighting device includes a light generation circuit that emits light and a fault detection circuit that detects faults within the light generation circuit. The light generation circuit contains a LED driver that provides a constant current to multiple parallel LED strings. The light generation circuit also includes at least one operational amplifier based current mirror circuit that actively balances the current flowing through a reference LED string and one of the mirror LED strings. In other words, the operational amplifier based current mirror circuit regulates the current flowing through a mirror LED string to be about equal to the current passing through the reference LED string. By utilizing the operational amplifier based current mirror circuit, a fault detection circuit is able to sense a voltage level at a single node within the light generation circuit to determine whether one or more failures (e.g., open or short faults) occur within the parallel LED strings. The fault detection circuit does not sense voltage levels at two different nodes within the light generation circuit. The fault detection circuit also includes a window comparator circuit to generate a fault indication signal. By being able to sense faults at a single node, the fault detection circuit can exclude a differential amplifier that supplies an input signal to the window comparator circuit.

FIG. 1 is a block diagram of lighting device circuit 100 in accordance with various implementations. FIG. 1 illustrates that the lighting device circuit 100 contains a light generation circuit 102 and fault detection circuit 124. Within the light generation circuit 102 is a LED driver 122, a reference LED string 104, at least one mirror LED string 106 connected in parallel to the reference LED string 104, and at least one current mirror circuit 108. In one or more implementations, the LED driver 122 provides constant current at an input voltage ($V_{IN}$) to reference LED string 104 and mirror LED string 106. The current mirror circuit 108 performs current balancing by maintaining the current flow within the mirror LED string 106 to be about equal to the current flow for reference LED string 104. The fault detection circuit 124 includes a window comparator circuit 110 that detects for faults by comparing the voltage level measured at the fault sense node 120 to a reference low voltage ($V_{refL}$) and a reference high voltage ($V_{refH}$).

As shown in FIG. 1, the current mirror circuit 108 includes an operational amplifier 116 coupled to resistors 126 and 128. Utilizing operational amplifier 116 as part of the current mirror circuit 108 may provide better current matching (e.g., less than about 1% matching error) than other current mirror circuits, such as a bipolar junction transistor (BJT) based current mirror circuit (e.g., about a 5-10% matching error). The non-inverting terminal of the operational amplifier 116 is coupled to a resistor 126 with a resistance value of R, and the inverting terminal is coupled to a resistor 128 that has the same resistance value of R. The current mirror circuit 108 regulates the current flowing through resistor 128 to be about the same as the current flowing through resistor 126, which also means that voltage V1 and voltage V2 are about equal to each other. The amount of current flowing through resistor 126 is defined as V1/R, which is about equal to the current flowing through resistor 128 as defined as V2/R. Resistors 126 and 128 could also be implemented using a variety of different types of resistors. Examples of resistors include, but are not limited to, carbon composition resistors and semiconductor resistors (e.g., surface mount resistors). Additionally or alternatively, persons of ordinary skill in the art are aware that the current mirror circuit 108 may set the resistance values for resistors 126 and/or 128 using other types of electronic components (e.g., field-effect transistors (FETs) operating in triode region) in lieu of resistor components.

To balance current flows, the output of operational amplifier 116 couples to a gate node of transistor 118. Based on this configuration, the operational amplifier 116 is able to balance the currents flowing through resistors 126 and 128 by varying the resistance and voltage drop across transistor 118. The operational amplifier 116 controls the transistor 118 to act as a variable resistor. As an example, if one of the LEDs within the reference LED string 104 shorts, the voltage at the fault sense node 120 also drops. Because of the voltage drop at the fault sense node, the resistance and voltage drop across transistor 118 also decreases in order to maintain that voltage V1 is about equal to voltage V2. Example implementations for balancing current and compensating for failures within the reference LED string 104 and mirror LED string 106 are discussed in more detail with reference to FIGS. 2A-2E.

In one or more implementations, transistor 118 is an n-channel metal-oxide-semiconductor field-effect (NMOS) transistor. Although FIG. 1 illustrates that transistor 118 is a NMOS transistor, the current mirror circuit 108 could include other types of transistors, such as an n-type junction gate field-effect transistor (NJFET) and a bipoloar junction transistor (BJT) (e.g., NPN transistors). As shown in FIG. 1, the drain node of transistor 118 is coupled to the fault detection circuit 124, and the fault sense node 120 is located at the drain node of transistor 118. Based on the current matching accuracy of the current mirror circuit 108, the fault detection circuit 124 does not connect to another fault sense node 120 to detect for faults within the reference LED string 104 or mirror LED string 106. By having a single fault sense node 120, the fault detection circuit 124 does not include a differential amplifier circuit that evaluates differences between multiple fault sense nodes 120. Typically when sensing voltages at multiple fault sense nodes 120, the differential amplifier circuit would be coupled between the fault sense nodes 120 and the window comparator circuit 110.

FIG. 1 depicts that the fault detection circuit 124 includes a window comparator circuit 110. To compare the fault sense node 120 to both a $V_{refL}$ and a $V_{refH}$, the window comparator circuit 110 includes comparators 112 and 114. In FIG. 1, $V_{refL}$ is supplied to the non-inverting terminal of comparator 112 and $V_{refH}$ is supplied to the inverting terminal of comparator 114. The fault sense node 120 is connected to the non-inverting terminal of comparator 114 and the inverting terminal of 112. In FIG. 1, when a fault occurs, the window comparator circuit 110 generates a logic high, and when no fault occurs, the window comparator circuit 110 generates a logic low. In other implementations, the window comparator circuit 110 is able to perform the inverse where the window comparator circuit 110 generates a logic low when a fault occurs and a logic high when no fault occurs.

Although FIG. 1 illustrates a specific implementation of lighting device circuit 100 that include LED strings, the disclosure is not limited to the specific implementation illustrated in FIG. 1. For instance, a variety of comparator circuits could be implemented to detect faults at the fault sense node 120. In one implementation, rather than using comparators 112 and 114, the window comparator circuit 110 could perform an analog to digital conversion that outputs its digital signal to a microcontroller for detecting failures. Additionally or alternatively, although FIG. 1 illustrates that the lighting device circuit 100 includes a single reference LED string 104 and a single mirror LED string 106, other implementations could include multiple mirror LED strings 106 parallel to the reference LED string 104. Each mirror LED string 106 could be coupled to its own current mirror circuit 108 and window comparator circuit 110 to balance current and detect faults at a single node. For implementations that contain multiple parallel mirror LED strings 106, the fault detection circuit 124 would also have all of the window comparator circuits 110 couple to an OR-based logic circuit to indicate when a fault occurs at any of the LED strings. As an example, when the window comparator circuits 110 are set to generate a logic high when a fault occurs, the OR-based logic circuit would generate a logic high when any of the LED strings has a fault and a logic low when none of the LED strings have a fault. The use and discussion of FIG. 1 is only an example to facilitate ease of description and explanation.

Figure 2A:
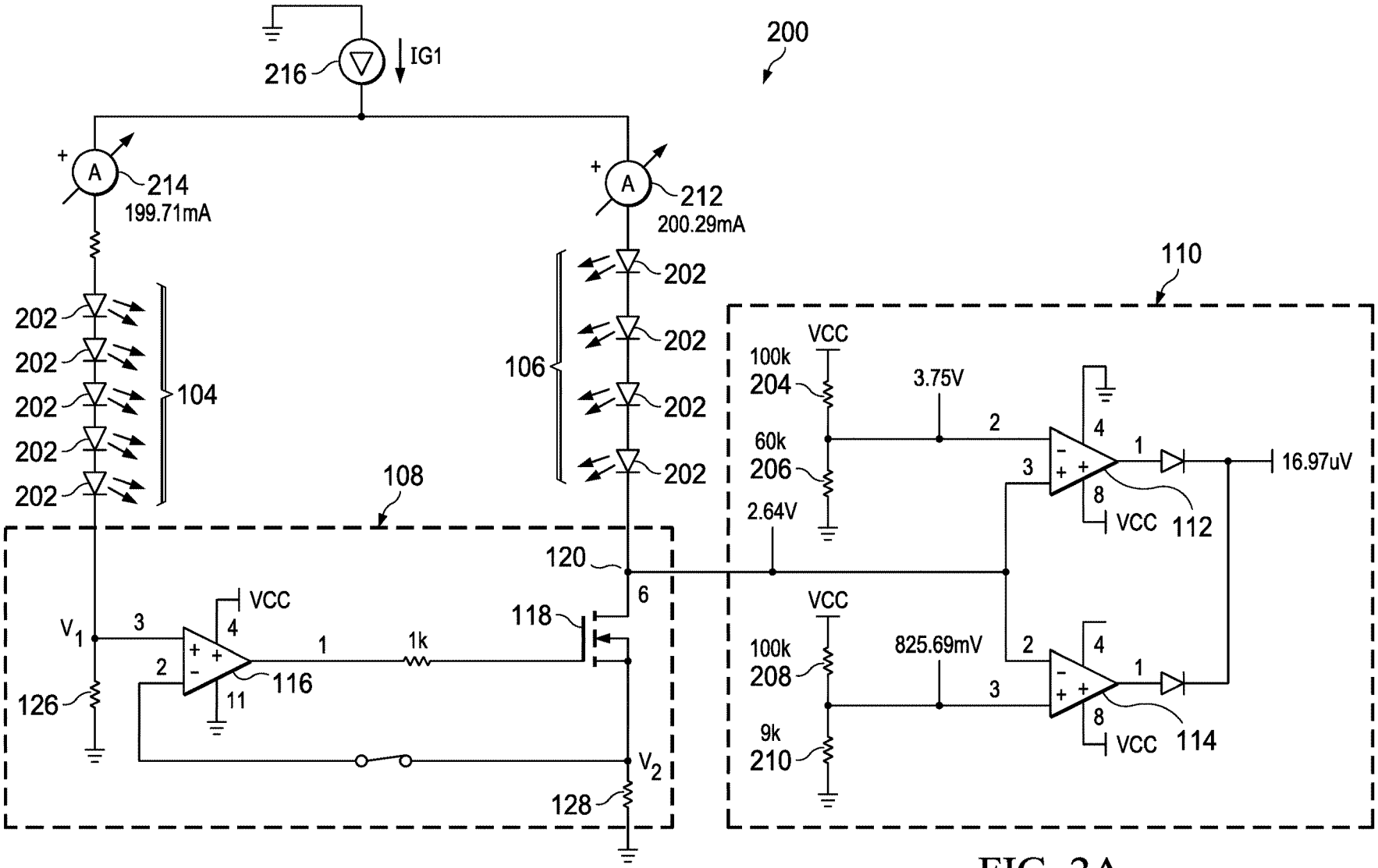
FIG. 2A is a schematic diagram of a lighting device circuit during normal operation conditions.

FIG. 2A is a schematic diagram of a lighting device circuit 200 during normal operation conditions. In particular, the lighting device circuit 200 represents a specific implementation of the lighting device circuit 100 shown in FIG. 1 that detects faults at a single fault sense node. In FIG. 2A, lighting device circuit 200 includes a constant current source 216 that generates a constant current $IG_1$. With reference to FIG. 1, the constant current source 216 is a simplified representation of the LED driver 122. Ammeters 212 and 214 are placed within lighting device circuit 200 for the purposes of verifying current that flows through the mirror LED string 106 and reference LED string 104, respectively. Other implementations of lighting device circuit 200 exclude ammeters 212 and 214 when the lighting device circuit 200 does not need to confirm current flows through the LED strings 104 and 106. During normal operating conditions, the constant current source 216 generates a total of about 400 mA (e.g., $IG_1$=400 mA), where each LED string 104 and 106 receives about 200 milliamps (mA).

Both the reference LED string 104 and mirror LED string 106 each include multiple LED components 202. The LED components 202 are generally a semiconductor light source that emits light when activated. For example, the LED components 202 are p-n junction diodes that release photons when electrons recombine with electron holes within the device. Examples of LEDs found within LED strings 104 and 106 include, but are not limited to blue-violet LEDs, white LEDs, phosphor-based LEDs, organic LEDs (OLEDs), and quantum dot LEDs. The LED components 202 may be found within the lighting device circuit 200 as through-hole packages and/or surface mount packages. Other implementations of lighting device circuit 200 include lighting devices other than LEDs. The terms "LEDs components" and "LED strings" can also be generically referred to and interchanged with the terms "light emitting components" and "strings of light emitting components," respectively.

FIG. 2A illustrates that the LED components 202 in both the reference LED string 104 and mirror LED string 106 are connected in series. Specifically, the reference LED string 104 includes five LED components 202 connected in series, and the mirror LED string 106 includes four LED components 202 connected in series. The constant current source 216 provides sufficient current to light each of the LED components 202 within both the reference LED string 104 and mirror LED string 106. The voltage drop across each of the LED components 202, which can also be referred to within this disclosure as the LED forward voltage, are about the same. In FIG. 2A, each of the LED components 202 have a LED forward voltage of about 2 V.

The reference LED string 104 and mirror LED string 106 have different LED voltage drop totals. In FIG. 2A, the reference LED string 104 includes one extra LED component 202 that provides an additional voltage drop (e.g., about 2 V) when compared to mirror LED string 106. The extra LED component acts as a reference sense voltage for the window comparator circuit 110 to detect at the fault sense node 120 during normal operations. As shown in FIG. 2A, in normal operating conditions and based on the extra LED component 202, the voltage at the fault sense node 120 is set to be about 2.64 V. The operational amplifier 116 drives transistor 118 within the current mirror circuit 108 to generate about a 2 V drop because of the extra LED component 202. Other implementations of the lighting device circuit 200 include more than one extra LED component 202 to generate a desired reference sense voltage. Additionally or alternatively, the reference LED string 104 and mirror LED string 106 could replace one or more of the extra LED components 202 with some other component, such as a resistor (e.g., a burn resistor), to provide the additional voltage drops for the reference LED string 104.

The window comparator circuit 110 compares the voltage detected at the fault sense node 120 to two reference fault voltages to detect faults within the reference LED string 104 and/or mirror LED string 106. FIG. 2A depicts that comparator 112 compares the voltage at the fault sense node 120 to a reference high voltage $V_{refH}$ that is set to about 3.75 V, and comparator 114 compares the voltage at the fault sense node 120 to a reference low voltage $V_{refL}$ that is set to about 825 millivolts (mV). The reference high voltage $V_{refH}$ couples to the inverting terminal of comparator 112 and reference low voltage $V_{refL}$ couples to the inverting terminal of comparator 114. To generate both reference high voltage $V_{refH}$ and reference low voltage $V_{ref}$, the window comparator circuit 110 utilizes a voltage divider circuit based on resistance values of resistors 204, 206, 208, and 210. FIG. 2A illustrates that resistors 204 and 206 have a 5:3 ratio and are set at 100 kilo-Ohms (kΩ) and 60 kΩ, respectively, and resistors 208 and 210 have a 100:9 ratio and are set to 100 kΩ and 9 kΩ, respectively. Other implementations of the window comparator circuit 110 include other types of voltage divider circuits and/or resistance values for resistors 204, 206, 208, and 210 to generate both reference high voltage $V_{refH}$ and reference low voltage $V_{refL}$.

During normal operating conditions, the window comparator circuit 110 detects at the fault sense node 120 the reference sense voltage of 2.64 V based on the extra LED component 202. In this instance, since the reference sense voltage is between the reference high voltage $V_{refH}$ and the reference low voltage $V_{refL}$, the window comparator circuit 110 outputs a relatively low voltage (e.g., about zero V), which represents a logic zero. When a fault occurs within either the reference LED string 104 or the mirror LED string 106, the voltage at the fault sense node 120 changes to be outside the range that reference high voltage $V_{refH}$ and the reference low voltage $V_{refL}$ defines. For example, a short circuit within the reference LED string 104 could cause the voltage at the fault sense node 120 to fall below the reference low voltage $V_{refL}$. In another example, a short circuit within the mirror LED string 106 could cause the fault sense node to exceed the reference high voltage $V_{refH}$. In either example, the window comparator circuit 110 outputs a relatively high voltage (e.g., about 10 V) as a result of the faults. Balancing current and compensating for failures within the reference LED string 104 and mirror LED string 106 are discussed in more detail with reference to FIGS. 2B-2E.

Figure 2B:
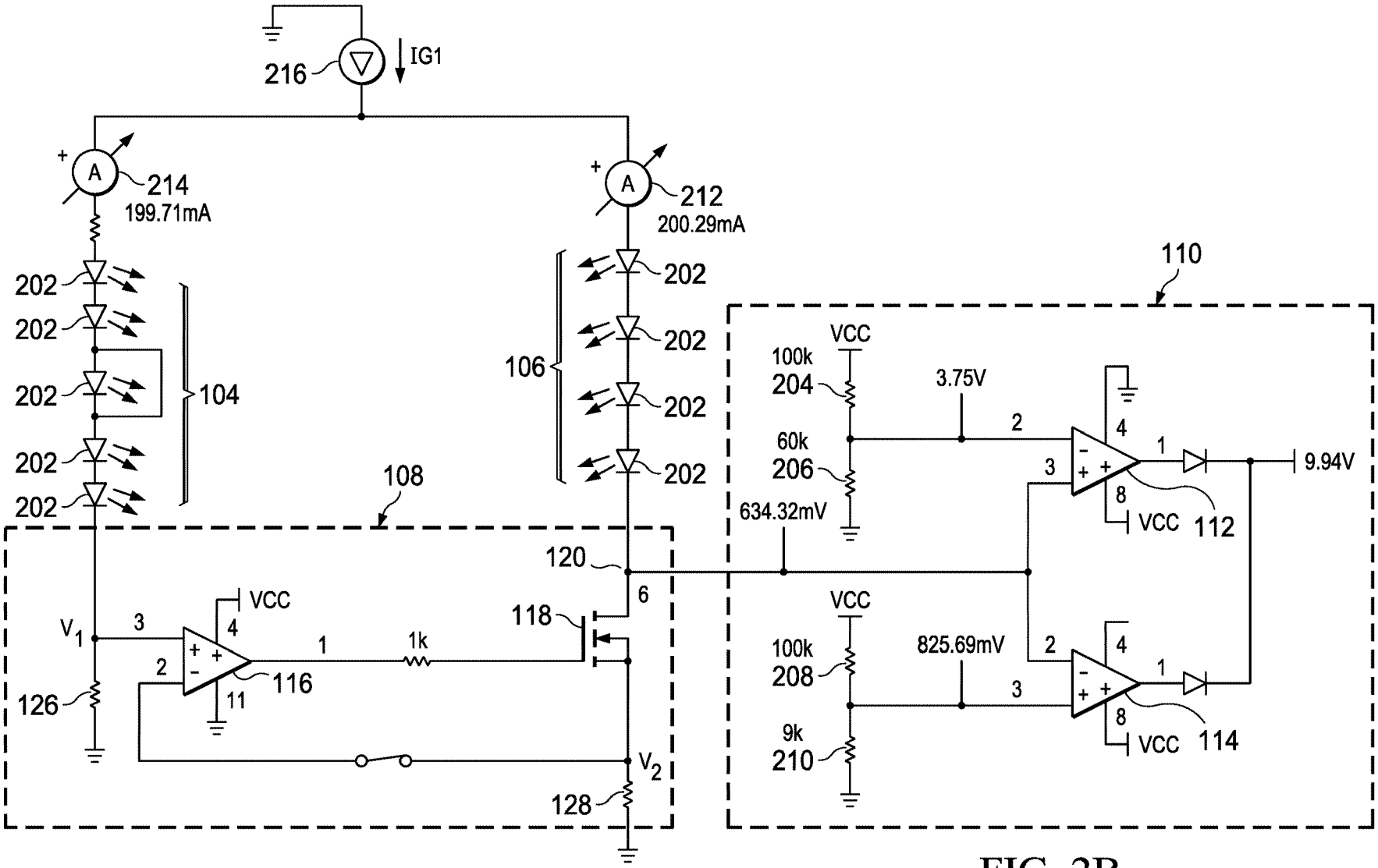
FIG. 2B is a schematic diagram of a lighting device circuit that has a short failure within reference LED string.

FIG. 2B is a schematic diagram of a lighting device circuit 200 that has a short failure within reference LED string 104. In FIG. 2B, the middle or third LED component 202 within the reference LED string 104 fails and causes a short. At this point, the LED component 202 no longer provides a voltage drop of about 2 V. To compensate for the short failure, the current mirror circuit 108 balances the current flowing through the reference LED string 104 and mirror LED string 106 to both be about equal (e.g., 200 mA). To perform current balancing, the operational amplifier 116 adjusts the transistor's 118 voltage drop such that voltages V1 and V2 are about equal. To provide a constant current of 400 mA after the short failure, the constant current source 216 drops the input voltage $V_{IN}$ to reference LED string 104 and mirror LED string 106. The lower input voltage $V_{IN}$ eventually causes the voltage at the fault sense node 120 to drop to about 634 mV.

The window comparator circuit 110 compares the voltage at the fault sense node 120 to reference low voltage $V_{refL}$ and reference high voltage $V_{refH}$. Recall that the window comparator circuit 110 can utilize a single sense node 120 since the current mirror circuit 108 is relatively accurate (e.g., less than 1% current matching error). In particular, when implementing current matching, the mirror circuit 108 causes the voltage at the single sense node 120 to change during a fault. In FIG. 2B, based on the resistance values of resistors 204, 206, 208, and 210, reference low voltage $V_{refL}$ is set to about 825 mV and reference high voltage $V_{refH}$ is set to be about 3.75 V. In normal operating conditions shown in FIG. 2A, the voltage at the fault sense node 120 is set to the reference sense voltage (e.g., about 2.64 V). Because of the short failure within the reference LED string, the voltage at the fault sense node 120 drops from about 2.64 V to about 634 mV. When comparator 112 compares the voltage at the fault sense node 120 to reference low voltage $V_{refL}$ (e.g., 825 mV), comparator 112 determines that the voltage at the fault sense node 120 is less than reference low voltage $V_{refL}$. Comparator 112 then causes the window comparator circuit 110 to output a relatively high voltage (e.g., about 9.94 V), which represents a logic high and that a fault exists within one of the LED strings 104 and 106.

Figure 2C:
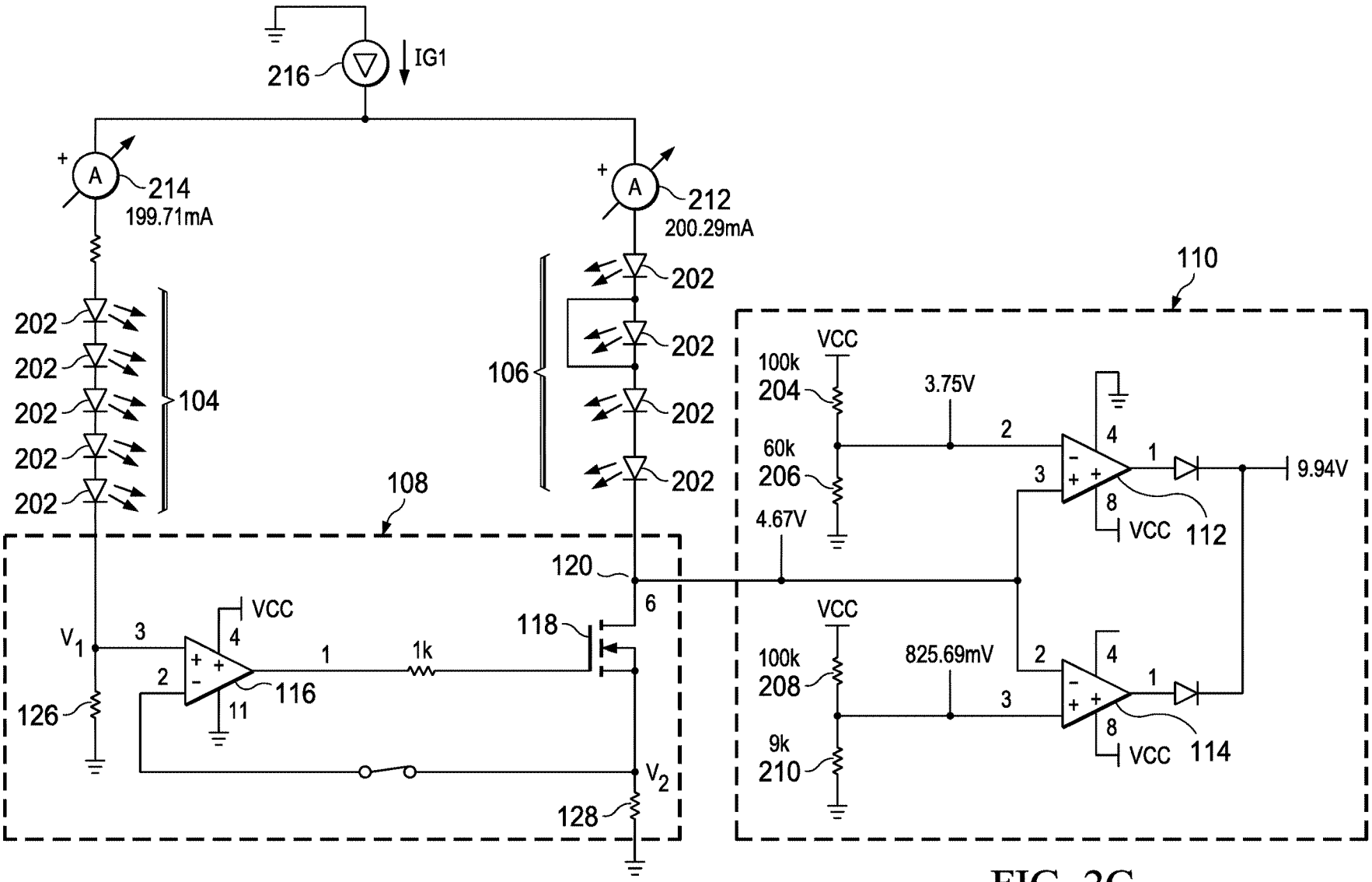
FIG. 2C is a schematic diagram of a lighting device circuit that has a short failure within mirror LED string.

FIG. 2C is a schematic diagram of a lighting device circuit 200 that has a short failure within mirror LED string 106. FIG. 2C depicts that one of the LED components 202 within the mirror LED string 106 fails and causes a short. The failed LED component 202 no longer provides a voltage drop of about 2 V within the mirror LED string 106. After the short occurs, similar to FIG. 2B, the current mirror circuit 108 balances the current flowing through the reference LED string 104 and mirror LED string 106 to both be about equal (e.g., about 200 mA). To perform current balancing, the operational amplifier 116 increases the transistor's 118 voltage drop to compensate for the short within the mirror LED string 106. As shown in FIG. 2C, the voltage at the single fault sense node 120 increases by about 2 V (e.g., from about 2.64 V to about 4.67 V) because of the short failure within the mirror LED string 106. In contrast to FIG. 2B, a short failure within the mirror LED string 106 does not cause a drop in the input voltage $V_{IN}$ supplied to reference LED string 104 and mirror LED string 106.

The window comparator circuit 110 compares the voltage at the fault sense node 120 to reference low voltage $V_{refL}$ and reference high voltage $V_{refH}$ after the short failure. In FIG. 2C, based on the resistance values of resistors 204, 206, 208, and 210, reference low voltage $V_{refL}$ is set to about 825 mV and reference high voltage $V_{refH}$ is set to be about 3.75 V. With reference to FIG. 2A, in normal operating conditions, the voltage at the fault sense node 120 is set to the reference sense voltage (e.g., about 2.64 V). Because of the short failure at the LED component 202, the voltage at the fault sense node 120 increases from about 2.64 V to about 4.67 V. When comparator 114 compares the voltage at the fault sense node 120 to reference high voltage $V_{refH}$ (e.g., 3.75 V), comparator 114 determines that the voltage at the fault sense node 120 is greater than reference high voltage Comparator 114 then causes the window comparator circuit 110 to output a relatively high voltage (e.g., about 9.94 V), which represents a logic high and that a fault exists within one of the LED strings 104 and 106.

Figure 2D:
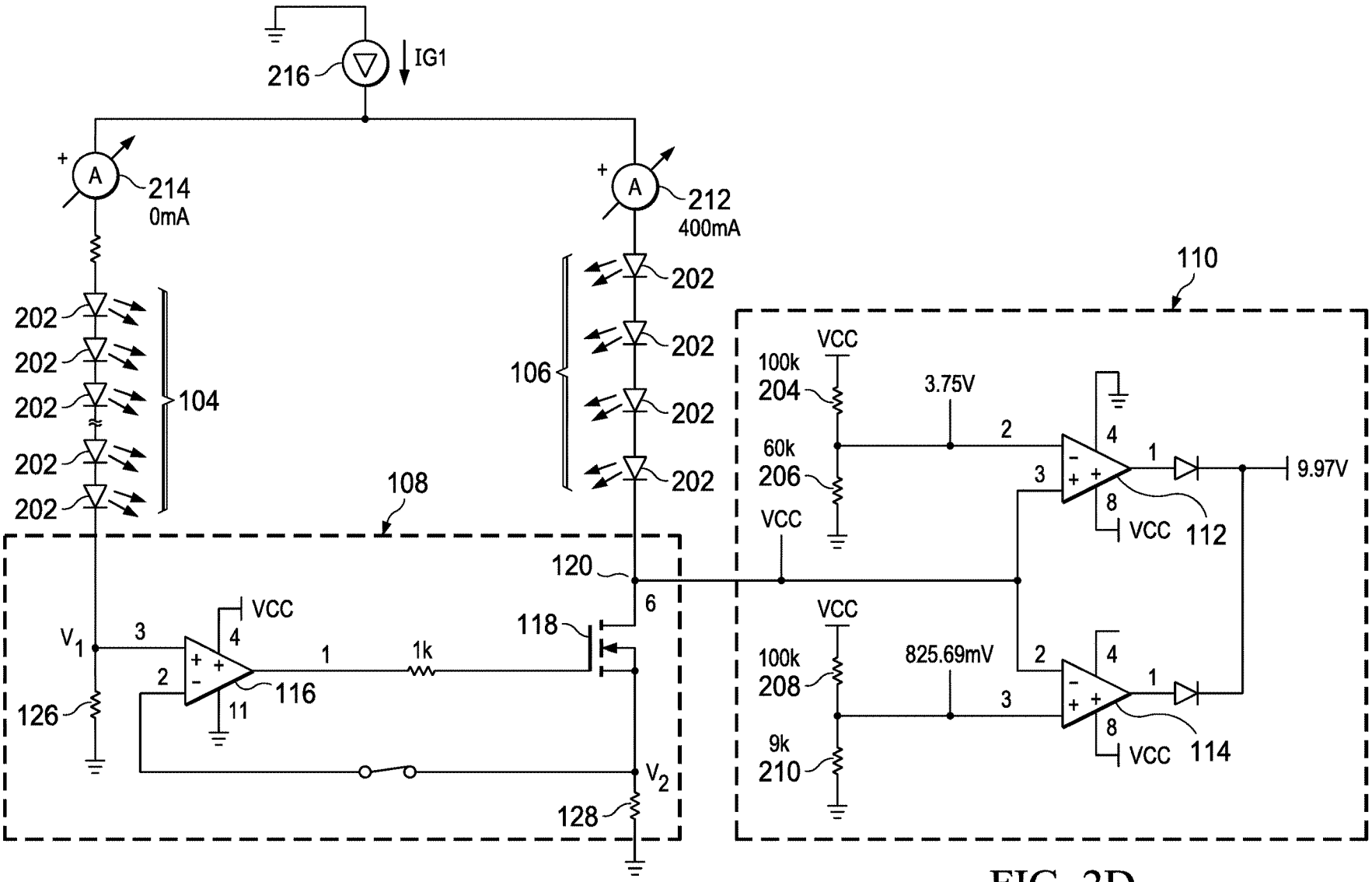
FIG. 2D is a schematic diagram of a lighting device circuit that has an open failure within reference LED string.

FIG. 2D is a schematic diagram of a lighting device circuit 200 that has an open failure within reference LED string 104. As shown in FIG. 2D, one of the LED components 202 within the reference LED string 104 is disconnected from another LED component 202 to form an open circuit failure. The open circuit failure causes the constant current source 216 to route the entire 400 mA to the mirror LED string 106 and about zero current to the reference LED string 104. After the open circuit failure, the voltage at the single fault sense node 120 increases to a relatively high voltage. In FIG. 2D, the voltage at the single fault sense node 120 is shown to equal a power supply voltage. Although not illustrated in FIG. 2D, the lighting device circuit 200 can include a current limiting circuit to prevent damage to the LED components 202 within mirror LED string 106.

The window comparator circuit 110 compares the voltage at the fault sense node 120 to reference low voltage $V_{refL}$ and reference high voltage $V_{refH}$ after the open failure. In FIG. 2D, based on the resistance values of resistors 204, 206, 208, and 210, reference low voltage $V_{refL}$ is set to about 825 mV and reference high voltage $V_{refH}$ is set to be about 3.75 V.

With reference to FIG. 2A, in normal operating conditions, the voltage at the fault sense node 120 is set to the reference sense voltage (e.g., about 2.64 V). Because of the open failure within the reference LED string 104, the voltage at the fault sense node 120 increases from about 2.64 V to about a designated power supply voltage (e.g. about 10 V). When comparator 114 compares the voltage at the fault sense node 120 to reference high voltage $V_{refH}$ (e.g., 3.75 V), comparator 114 determines that the voltage at the fault sense node 120 is greater than high low voltage $V_{refH}$. Comparator 114 then causes the window comparator circuit 110 to output a relatively high voltage (e.g., about 9.97 V), which represents a logic high and that a fault exists within one of the LED strings 104 and 106.

Figure 2E:
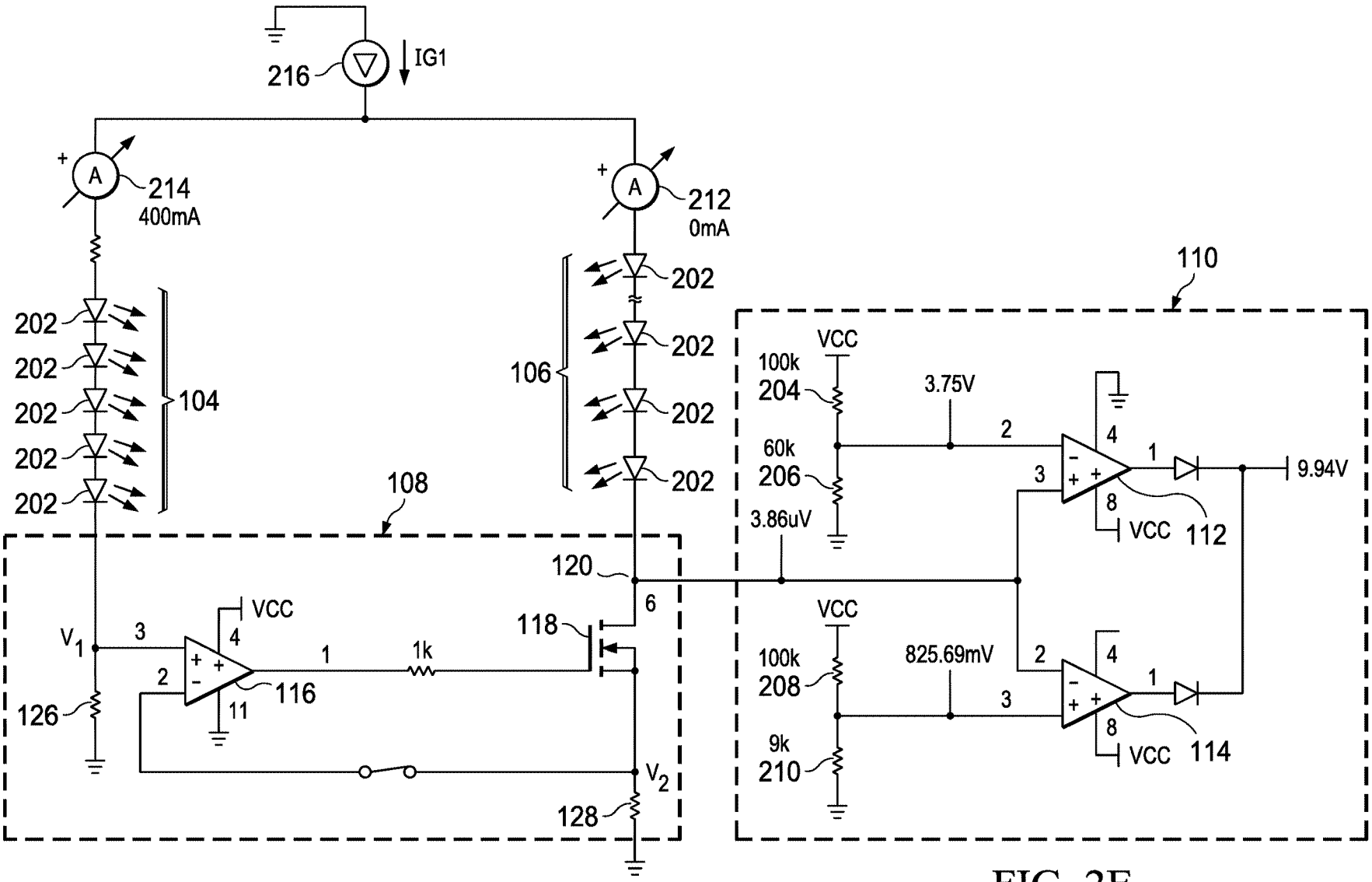
FIG. 2E is a schematic diagram of a lighting device circuit that has an open failure within mirror LED string.

FIG. 2E is a schematic diagram of a lighting device circuit 200 that has an open failure within mirror LED string 106. FIG. 2E depicts that an open failure occurs within the mirror LED string 106 where one of the LED components 202 within the mirror LED string 106 is disconnected from another LED component 202. The open circuit failure causes the constant current source 216 to provide the entire 400 mA to the reference LED string 104 and about zero current to the mirror LED string 106. After the open circuit failure, the voltage at the single fault sense node 120 decrease to a relatively low voltage (e.g., about zero volts). In FIG. 2E, the voltage at the single fault sense node 120 is shown to equal a power supply voltage. Although not illustrated in FIG. 2E, the lighting device circuit 200 could include a current limiting circuit to prevent damage to the LED components 202 within reference LED string 104.

The window comparator circuit 110 compares the voltage at the fault sense node 120 to reference low voltage $V_{refL}$ and reference high voltage $V_{refH}$ after the short failure. Recall that the window comparator circuit 110 can utilize a single fault sense node 120 since the current mirror circuit 108 is relatively accurate (e.g., less than 1% current matching error). In FIG. 2E, based on the resistance values of resistors 204, 206, 208, and 210, reference low voltage $V_{refL}$ is set to about 825 mV and reference high voltage $V_{refH}$ is set to be about 3.75 V. With reference to FIG. 2A, in normal operating conditions, the voltage at the fault sense node 120 is set to the reference sense voltage (e.g., about 2.64 V). Because of the open failure within the mirror LED string 106 the voltage at the fault sense node 120 drops from about 2.64 V to about zero V. When comparator 114 compares the voltage at the fault sense node 120 to reference low voltage $V_{refL}$ (e.g., about 825 mV), comparator 114 determines that the voltage at the fault sense node 120 is less than reference low voltage $V_{refL}$. Comparator 114 then causes the window comparator circuit 110 to output a relatively high voltage (e.g., about 9.94 V), which represents a logic high and that a fault exists within one of the LED strings 104 and 106.

Figure 3:
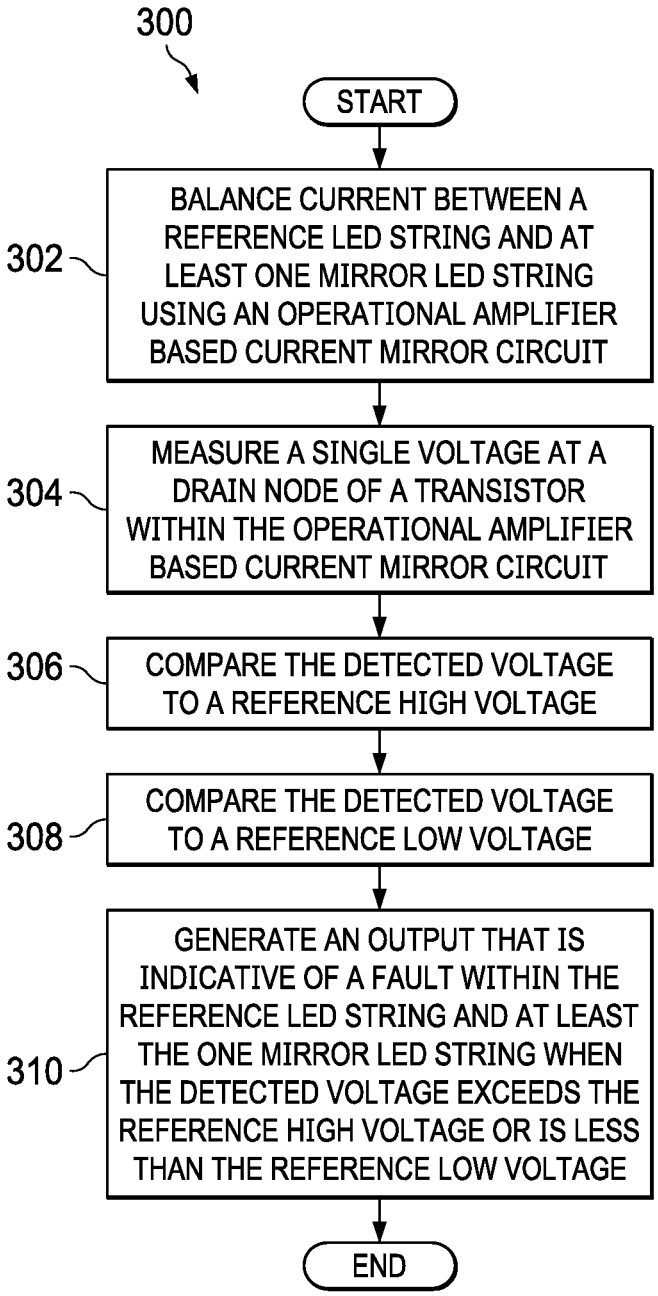
FIG. 3 is a flow chart of an implementation of a method to perform current balancing and detect fault at a single fault sense node.

FIG. 3 is a flow chart of an implementation of a method 300 to perform current balancing and detect fault at a single fault sense node. Using FIGS. 1 and 2A as examples, method 300 can be implemented within the lighting device circuit 100 and 200, respectively. In particular, method 300 may utilize at least one operational amplifier based current mirror circuit to balance current flowing through the reference LED string 104 and mirror LED string 106. Method 300 may be applicable to lighting device circuits that have more than one mirror LED string 106. Method 300 may also utilize at least one window comparator circuit to detect faults at a single fault sense node. Although FIG. 3 illustrates that the blocks of method 300 are implemented in a sequential operation, method 300 is not limited to this order of operations, and instead other implementations of method 300 may have one or more blocks implemented in parallel operations. For example, blocks 306 and 308 can be implemented sequentially or in parallel.

Method 300 starts at block 302 and balances current between a reference LED string and at least one mirror LED string using an operational amplifier based current mirror circuit. Using FIG. 2B as an example, method 300 matches the current flowing through resistors 126 and 128 within the operational amplifier based current mirror circuit. The voltages V1 and V2 are about equal when method 300 performs current balancing. When a short occurs, the operational amplifier based current mirror adjusts the voltage drop across a transistor such that voltages V1 and V2 are about equal. Method 300 then moves to block 304.

At block 304, method 300 measures a single voltage at a drain node of the transistor within the operational amplifier based current mirror circuit. Using FIG. 2A as an example, the drain node of transistor 118 is also coupled to the mirror LED string 106. Method 300 does not measure other voltages from other parts of the reference LED string 104 and mirror LED string 106. Method 300 also does not use a differential amplifier since method 300 only measures a single voltage at the drain node of the transistor.

Method 300 continues to block 306 and compares the detected voltage to a reference high voltage. The reference high voltage may be set based on a voltage divider. If the detected voltage exceeds the reference high voltage, method 300 determines a fault exists within the mirror LED string, reference LED string, or both. Method 300 also proceeds to block 308 and compares the detected voltage a reference low voltage. Similar to the reference high voltage, the reference low voltage can be set based on a voltage divider. Certain failures within the mirror LED string and the reference LED string could cause the detected voltage to drop below the reference low voltage. Method 300 then moves to block 310 and generates an output that is indicative a fault within the reference LED string and at least the one mirror LED string when the detected voltage exceeds the reference high voltage or is less than the reference low voltage. Stated another way, if the detected voltage falls outside the ranges set by the reference high voltage and the reference low voltage, method 300 generates an output indicating a fault (e.g., a logic high value).

At least one implementation is disclosed and variations, combinations, and/or modifications of the implementation(s) and/or features of the implementation(s) made by a person having ordinary skill in the art are within the scope of the disclosure. Alternative implementations that result from combining, integrating, and/or omitting features of the implementation(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means±10% of the subsequent number, unless otherwise stated.

While several implementations have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various implementations as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise.

What is claimed is:

1. A lighting device circuit comprising:

a reference light emitting diode (LED) string;

a mirror LED string coupled in parallel to the reference LED string;

an operational amplifier input and a second input, wherein the first input is coupled to a resistor measuring the current through the reference LED string and the second input is coupled to a resistor measuring the current through the mirror LED string; and a window comparator circuit having an input that is coupled to a fault sense node and adapted to receive a voltage input from the fault sense node, wherein the fault sense node is directly connected to a drain node of a transistor having a gate node coupled to the output of the operational amplifier and to a LED within the mirror LED string.

2. The lighting device circuit of claim 1, wherein the reference LED string includes a first number of LED components and the mirror LED string includes a second number of LED components, and wherein the first number of LED components is greater than the second number of LED components.

3. The lighting device circuit of claim 2, wherein the LED components within the reference LED string are connected in series and the LED components within the mirror LED string are connected in series.

4. The lighting device circuit of claim 1, further comprising an LED driver that is coupled to the reference LED string and the mirror LED string.

5. The lighting device circuit of claim 4, wherein the LED driver provides a constant current to the reference LED string and the mirror LED string.

6. The lighting device circuit of claim 1, wherein the window comparator circuit includes a first comparator that is connected to a reference high voltage and the fault sense node.

7. The lighting device circuit of claim 6, wherein the window comparator circuit includes a second comparator that is connected to a reference low voltage and the fault sense node.

8. The lighting device circuit of claim 6, wherein the reference low voltage is generated from a voltage divider circuit.

9. The lighting device circuit of claim 1, wherein the window comparator circuit is directly connected to the fault sense node.

10. An apparatus comprising:

a light generation circuit comprising:

a reference light emitting diode (LED) string;

a resistor directly coupled to the reference LED string;

a mirror LED string coupled in parallel to the reference LED string;

an operational amplifier having a first input and a second input, wherein the first input is coupled to a resistor measuring the current through the reference LED string and the second input is coupled to a resistor measuring the current through the mirror LED string; and a fault detection circuit that includes a window comparator circuit that receives a voltage from a fault sense node within the light generation circuit, wherein the window comparator circuit does not receive voltage inputs from other nodes within the light generation circuit;

wherein the fault sense node is directly connected to a drain node of a transistor having a gate node coupled to the output of the operational amplifier and a LED within the mirror LED string.

11. The apparatus of claim 10, wherein the window comparator circuit compares the voltage from the fault sense node to a reference low voltage and a reference high voltage and determines that a failures occurs within the light generation circuit when the voltage exceeds the reference high voltage or is less than the reference low voltage.

12. The apparatus of claim 10, wherein the reference LED string includes a first number of LED components and the mirror LED string includes a second number of LED components, and wherein the first number of LED components is greater than the second number of LED components.

* * * * *